US009151303B2

(12) United States Patent
Jubert et al.

(10) Patent No.: US 9,151,303 B2
(45) Date of Patent: Oct. 6, 2015

(54) HYDRAULIC ACTUATOR WITH AUTOMATIC PURGING AT THE END OF ITS STROKE

(75) Inventors: Xavier Jubert, Boulogne-Billancourt (FR); Ludovic Dufay, Saint-Cyr-l'Ecole (FR); Sébastien Ernis, Chatenay-Malabry (FR)

(73) Assignee: MESSIER-BUGATTI-DOWTY, Velizy Villacoublay (FR)

( * ) Notice: Subject to any disclaimer, the term of this patent is extended or adjusted under 35 U.S.C. 154(b) by 765 days.

(21) Appl. No.: 13/436,276

(22) Filed: Mar. 30, 2012

(65) Prior Publication Data

US 2012/0247318 A1 Oct. 4, 2012

(30) Foreign Application Priority Data

Mar. 31, 2011 (FR) ..... 11 52770

(51) Int. Cl.

| | |
|---|---|
| ***F15B 15/22*** | (2006.01) |
| ***F15B 15/14*** | (2006.01) |
| ***F15B 21/04*** | (2006.01) |
| ***F15B 15/20*** | (2006.01) |

(52) U.S. Cl.

CPC ..... *F15B 15/149* (2013.01); *F15B 15/20* (2013.01); *F15B 21/04* (2013.01); *F15B 21/044* (2013.01)

(58) Field of Classification Search

CPC ..... F15B 21/04; F15B 15/14
USPC ..... 91/394, 522, 399; 92/79
See application file for complete search history.

(56) References Cited

U.S. PATENT DOCUMENTS 3,552,273 A * 1/1971 Resuggan ..... 91/401

FOREIGN PATENT DOCUMENTS

| | | |
|---|---|---|
| FR | 1 211 772 A | 3/1960 |
| JP | 62-130204 U | 8/1987 |
| JP | 8-312609 A | 11/1996 |

OTHER PUBLICATIONS

French Search Report of FR 11 52770, dated Oct. 28, 2011.

* cited by examiner

*Primary Examiner* — Edward Look
*Assistant Examiner* — Daniel Collins
(74) *Attorney, Agent, or Firm* — Sughrue Mion, PLLC

(57) ABSTRACT

A hydraulic actuator containing a hollow body defining a cylindrical cavity and a rod which is mounted to slide within the body along a sliding axis between two end positions and which is integral with a piston sliding in a sealed manner within the cylindrical cavity in order to define two chambers. The rod defines an interior passage, connecting the two chambers, which has a valve comprising a shut-off member which is returned towards a seat and closes the passage. The rod receives a push member which can move relative to the rod between a position apart from the shut-off member and a position forcing the shut-off member to open. The push member is constrained, when the rod reaches the end of its stroke, by the push member engaging with a portion of the hollow body.

1 Claim, 2 Drawing Sheets

HYDRAULIC ACTUATOR WITH AUTOMATIC PURGING AT THE END OF ITS STROKE

SUBJECT OF THE INVENTION

The invention has for its subject a hydraulic actuator with automatic purging, allowing the air contained in one of the chambers thereof to be purged at least when the rod reaches the end of its stroke.

BRIEF DESCRIPTION OF THE INVENTION

Accordingly, what is proposed is a hydraulic actuator comprising a hollow body defining a cylindrical cavity;

a rod which is mounted so as to be able to slide within the body along a sliding axis between two end positions and which is integral with a piston sliding in a sealed manner within the cylindrical cavity of the body in order to define two chambers therein. According to the invention, the rod defines an interior passage connecting the two chambers, this passage being equipped with a purge valve comprising a shut-off member which is returned towards a seat and which engages with the latter to close the passage, the rod receiving a push member which can move relative to the rod between a position in which it is moved apart from the shut-off member of the valve and a position in which it forces the shut-off member to open, the push member being constrained in the latter position when the rod reaches the end of its stroke in one of its end positions as a result of the push member engaging with a portion of the hollow body.

Thus, the opening of the purge valve takes place automatically and systematically each time the rod reaches the end of its stroke. The valve then remains open for as long as the rod remains at the end of its stroke.

According to one specific embodiment, the push member comprises a needle which is mounted so as to be able to slide within the rod in a direction parallel to the sliding axis of the rod, the needle having a distal end close to the valve and a proximal end close to a crosspiece which is floatingly mounted across the rod in a longitudinal slot therein so as to project to either side of the rod such that, when the rod reaches the end of its stroke, ends of the crosspiece will bear against the facing portion of the hollow body, pushing the crosspiece relative to the needle such that said crosspiece in turn pushes the needle, which in turn pushes the shut-off member of the valve to force it to open.

BRIEF DESCRIPTION OF THE FIGURES

A better understanding of the invention will be gained by way of the description which follows of one specific embodiment of the invention, with reference to the figures in the appended drawings, in which.

DETAILED DESCRIPTION OF THE INVENTION

Figure 2:
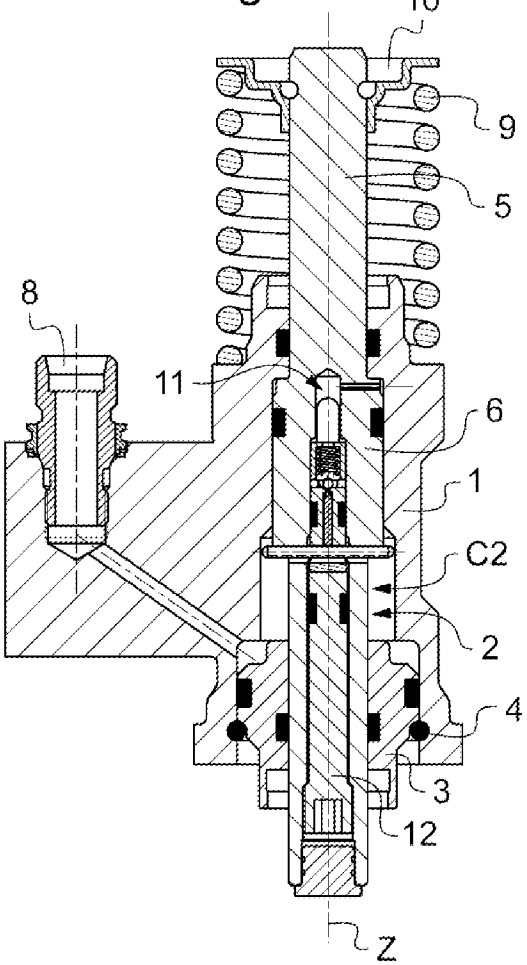
FIG. 2 is a view in longitudinal section of the ram shown in FIG. 1, taken on a plane perpendicular to the section plane in FIG. 1.
Figure 1:
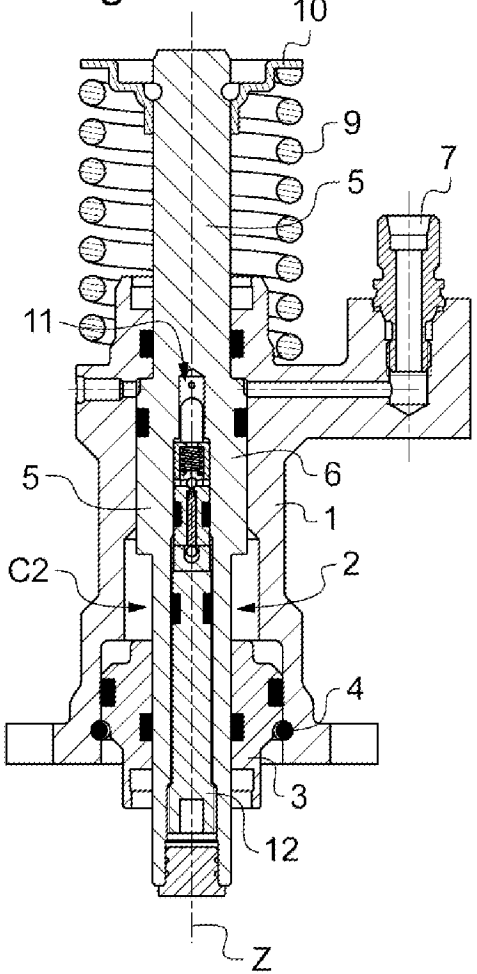
FIG. 1 is a view in longitudinal section of a single-acting ram, the rod being shown in the retracted position towards which it is elastically returned.

With reference to FIGS. 1 and 2, the actuator of the invention is illustrated here in the form of a single-acting hydraulic ram comprising a cylinder 1 defining an open-ended cylindrical cavity 2 of axis Z which is closed in a sealed manner by a plug 3, in this case held in place on the body by a retaining ring 4. The assembly consisting of the cylinder 1 and the plug 3 forms a hollow body.

A rod 5 is mounted such that it can slide in a sealed manner inside the body 1 along the Z axis. Here, the rod 5 projects from the body on both sides, passing through the plug 3. The rod 5 forms a piston 6 which delimits two chambers C1 and C2 (the chamber C1 is more visible in FIG. 3) in the cavity 2. The chamber C1 is connected to an external pressure source by a supply port 7, while the chamber C2 is connected to a return port 8. The rod 5 is returned to the retracted position, illustrated in FIG. 1, by means of a spring 9 which bears, on the one hand, against the body 1 and, on the other hand, against a cup 10 which is secured to the rod 5.

Figure 4:
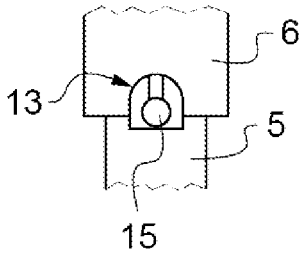
FIG. 4 is an enlarged external view of the rod in the position illustrated in FIG. 1, from the same angle of view.
Figure 5:
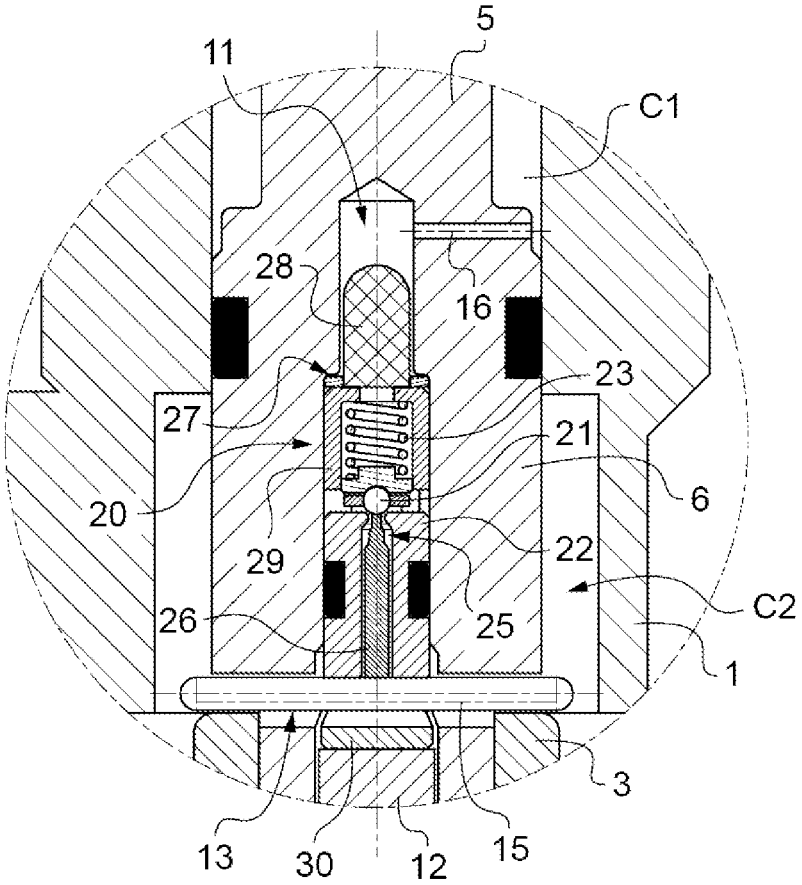
FIG. 5 is a detail view corresponding to the detail shown in FIG. 3.

The rod 5 is hollow and defines an open-ended internal cavity 11 closed in a sealed manner by a plug 12. As is more visible in FIG. 4, the rod comprises a transverse through-slot 13, extending here astride the offset portion delimiting the end of the piston 6.

Figure 3:
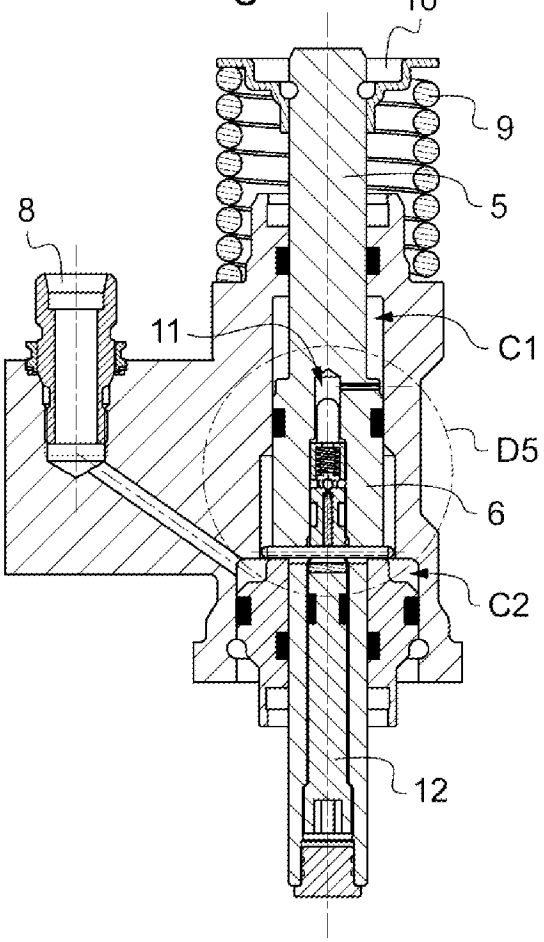
FIG. 3 is a view in longitudinal section that is analogous to FIG. 2, the rod having been pushed hydraulically into an extended position.

Passing through the slot 13 is a crosspiece 15 (visible at its end in FIG. 4) which extends so as to project to either side of the rod 5. When the rod 5 is pushed into the extended position (as illustrated in FIG. 3) by being supplied from the port 7, the piston 6 will bear against the plug 3 and the ends of the crosspiece 15 bear against the plug 3 such that the crosspiece 15 is moved longitudinally relative to the rod 5. It will be seen from FIG. 4 that the slot 13 is sufficiently high for the crosspiece 15 not to bear against the top of the slot 13 when the piston 6 is bearing against the plug 3.

The slot 13 brings the chamber C2 into communication with the internal cavity 11 in the rod 5. Moreover, a drilling 16 brings the internal cavity 11 and the chamber C1 into communication such that the rod 5 defines a fluid passage between the chambers C1 and C2. This passage is closed by a purge valve 20 comprising a ball 21 which is returned towards a seat 22 by a spring 23.

The seat 22 forms part of a succession of elements inserted with a tight fit in the cavity 11 and bearing against a shoulder 27 of the cavity 11, and respectively comprising a strainer 27, a cage 29 receiving the spring 23, the seat 22, a recessed yoke 30 to allow the crosspiece 15 to float in the slot 13, and finally the plug 12, which is screwed into a tapping in the internal cavity 11.

The seat 22 comprises an axial bore 25 which is closed by the ball 21 and in which a needle 26 is mounted with a sliding fit. The sliding fit is not air-tight. The needle has a distal end which extends in the vicinity of the ball 21, and a proximal end extending in the vicinity of the crosspiece 15. The length of the needle 26 is selected to ensure that, when the crosspiece 15 is not being pushed by the plug 3, the needle floats between the crosspiece 15 and the ball 21, with the result that the needle 26 is moved apart from the ball 21. This ball is then held against the seat 22 by the spring 23. By contrast, when the crosspiece 15 is pushed by the plug 3 (that is to say when the rod is in an extended position as in FIG. 3), the crosspiece 15 pushes the needle 26, which acts on the ball 21 to lift it off the seat 22 against the action of the spring 23. Thus, the purge valve 20 is kept open when the rod 5 is in the extended position, thereby allowing air contained in the chamber C2 to be purged, this air consequently being able to flow through the passage defined by the rod 5 between the chambers C1 and C2.

When the rod 5 is returned by the spring 9 to the retracted position, the crosspiece 15 is no longer pushed and therefore stops acting on the needle 26, with the result that the purge valve 20 closes again automatically.

The invention is not limited to what has just been described, but rather encompasses any variant coming within the scope defined by the claims.

In particular, although in this case the push member which opens the valve comprises a crosspiece and a needle, the invention covers any actuator comprising a push member which cooperates with the hollow body when the rod reaches one of its end positions in order to push the shut-off member of the valve.

Although in this case the valve is a ball valve, it would of course be possible to use any other type of valve, such as a needle valve.

The invention claimed is:

1. A hydraulic actuator comprising a hollow body (1, 3) defining a cylindrical cavity;

a rod (5) which is mounted so as to be able to slide within the body along a sliding axis between two end positions and which is integral with a piston sliding in a sealed manner within the cylindrical cavity of the body in order to define two chambers (C1, C2) therein; the rod defining an interior passage connecting the two chambers, said passage being equipped with a valve (20) comprising a shut-off member (21) which is returned towards a seat (22) and which engages with the seat to close the passage, and a push member (15, 26) received by the rod, which can move relative to the rod between a position in which it is moved apart from the shut-off member (21) of the valve and a position in which it forces the shut-off member to open, the push member being constrained in the latter position when the rod reaches an end of its stroke in one of its end positions as a result of the push member engaging with a portion (3) of the hollow body, wherein the push member (15, 26) comprises a needle (26) which is mounted so as to be able to slide within the rod in a direction parallel to the sliding axis of the rod, the needle having a distal end close to the valve and a proximal end close to a crosspiece (15) which is floatingly mounted across the rod in a longitudinal slot (13) therein so as to project to either side of the rod, whereby when the rod reaches the end of its stroke, ends of the crosspiece will bear against a facing portion (3) of the hollow body, pushing the crosspiece relative to the needle such that said crosspiece in turn pushes the needle, which in turn pushes the shut-off member of the valve to force it to open.

* * * * *